US008308412B2

(12) United States Patent
Takagi

(10) Patent No.: US 8,308,412 B2
(45) Date of Patent: Nov. 13, 2012

(54) ADHESIVE APPLICATOR AND BOOKMAKING APPARATUS USING THE SAME

(75) Inventor: Katsumasa Takagi, Kofu (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 961 days.

(21) Appl. No.: 11/797,132

(22) Filed: May 1, 2007

(65) Prior Publication Data

US 2007/0286706 A1 Dec. 13, 2007

(30) Foreign Application Priority Data

May 2, 2006 (JP) ..... 2006-128707

(51) Int. Cl.
*B42C 9/00* (2006.01)
*B05C 1/00* (2006.01)

(52) U.S. Cl. ..... 412/37; 412/14; 118/242

(58) Field of Classification Search ..... 412/8, 11, 412/13, 14, 33, 37, 901; 156/389; 118/241, 118/242, 261, 262
See application file for complete search history.

(56) References Cited

U.S. PATENT DOCUMENTS 3,866,568 A * 2/1975 Minami ..... 118/241
3,898,955 A * 8/1975 Rosette et al. ..... 118/261
7,527,465 B2 * 5/2009 Toyoizumi et al. ..... 412/37

* cited by examiner

*Primary Examiner* — Dana Ross
*Assistant Examiner* — Pradeep C Battula
(74) *Attorney, Agent, or Firm* — Manabu Kanesaka

(57) ABSTRACT

An adhesive applicator forms adhesive to a smooth surface at a predetermined thickness when applied to a sheet bundle edge. An adhesive storing container is disposed at an adhesive application position, and is equipped with an applicator roller device and a scraper blade that adjusts the thickness of the adhesive layer applied. A moving device drives the applicator roller device or the sheet bundle holding device so that the applicator roller device and scraper blade move relative to the sheet bundle. The scraper blade is configured to push or sweep away excess adhesive from one end of the sheet bundle to the other end thereof across the backside, removing excess adhesive while forming a smoothly finished surface of adequately softened and flow-able adhesive.

18 Claims, 10 Drawing Sheets

ADHESIVE APPLICATOR AND BOOKMAKING APPARATUS USING THE SAME

BACKGROUND OF THE INVENTION AND RELATED ART STATEMENT

The present invention relates to bookbinding apparatus that apply adhesive to a side edge of a series of sheets aligned to form a bundle and bind a cover sheet to the sheet bundle, or bookbinding apparatus in a bookbinding system that produces booklets by sequentially stacking sheets printed at an image forming apparatus to form a bundle of sheets, applying adhesive to a side edge of sheet bundle, and binding a cover sheet to the sheet bundle. More particularly the present invention relates to apparatus improvements that enable uniform application of adhesive to a backside of a sheet bundle, and accurate binding of the cover sheet to the sheet bundle.

Generally, this kind of bookbinding apparatus is widely used as a terminal device of an image forming apparatuses such as printers or copiers. After sheets formed with images are stacked in page order and aligned to form a bundle, the bookbinding apparatus applies adhesive to an edge of the sheet bundle and binds a cover sheet to that to form a booklet. Particularly, there have been a variety of systems proposed that automatically bind and cover a sheet bundle simultaneously to the printing of predetermined information. These systems are becoming increasingly common with the increase in on-demand printing, particularly with the recent improvements in the so-called computer-aided publishing.

This kind of bookbinding apparatus is a device that is separate to an image forming apparatus, and can be used as a stand-alone apparatus that applies adhesive to a side edge (a back side) of printed sheets stacked in a bundle, and forms a booklet by binding a separately conveyed cover sheet to an edge of the sheet bundle. Such bookbinding apparatus are also used as a part of a larger a system by connecting to a discharge outlet of an image forming apparatus. The system forms booklets by sequentially receiving printed sheets conveyed therefrom. For example, unexamined Patent Pub. 1 proposes a system that automatically finishes a booklet of sheets output from an image forming apparatus. According to that publication, sheets output by an image forming apparatus are received from a discharge outlet of that device and are guided to the discharge path. Then, they are stacked in a tray provided at a downstream side of the discharge path. The sheet bundle stacked on the tray in a substantially horizontal posture is turned 90 degrees and conveyed in a vertical posture to an adhesive applicator to be glued. The apparatus folds a cover sheet supplied from an inserter provided at a discharge path over the glued sheet bundle thereby binding the cover sheet to the sheet bundle to form a booklet.

In the system disclosed in Patent Publication, a container holding adhesive is provided to apply adhesive to a sheet bundle held in a vertical posture by gripping means. A roller is disposed in the container. The roller is coated with adhesive and travels along the bottom edge of the sheets to apply adhesive thereto. Hot-melt adhesive is used as the adhesive or bonding agent. The adhesive is in a solid form when charged to the container, making it is easier to handle. The adhesive is melted in the container, and impregnates the roller so that it can be applied to the edge of the sheet bundle. After application to the sheet bundle edge, the adhesive hardens and adheres to the sheets.

It is necessary to adjust the thickness of the adhesive layer when applying adhesive to an edge of a sheet bundle. For example, if the sheet bundle is thick, a thick layer of adhesive will be securely infused between the pages of the sheets in the bundle thereby ensuring a good bond. Conversely, if the sheet bundle is thin and the adhesive layer is thinner, the adhesive will not be pressed out to the front and back surfaces of the cover sheet when it is folded over the sheet bundle. It is known practice in the art to adjust the layer of adhesive applied by adjusting the gap between the applicator roller and sheet bundle edge, and to use a blade, plate or the like, to scrape or sweep away excess adhesive. Conventionally, a blade is disposed perpendicularly to the edge across the back of the sheet bundle. As it moves from one end of the sheet bundle to the other, the blade forms a uniform adhesive layer.

Patent Publication: Japanese Unexamined Patent Publication No. 2004-209869

To form a uniform adhesive layer when applying adhesive with an applicator roller to the backside edge of the sheet bundle held in the predetermined posture as described above, a knife edge of the plate-shaped blade is used to scrape or sweep away adhesive. Conventionally, the plate-shaped blade is disposed across the backside of the sheet bundle perpendicular to the edge of the sheet bundle. For that reason, the adhesive layer is unevenly formed by the applicator roller. If the viscosity of the adhesive is not uniform, the blade cause blemishes when sweeping away excess adhesive, thus it is impossible to form a uniform adhesive layer with this type of system. For example, as shown in FIG. 10, because of the surface tension, the adhesive will droop from both edges causing the center area to develop channels. Channels will remain at the center area if the blade (represented by the line z-z in that drawing) sweeps away adhesive to the thickness (h in the drawing) of the adhesive layer. If the viscosity of the adhesive is high when swept away, deficiencies such as blemishes will remain.

When a cover sheet is folded over the sheet bundle, either the unevenness formed by the adhesive layer appears in portions of the backside of the booklet, or wrinkles will appear. If the viscosity of the adhesive is lowered in order to solve these problems, the adhesive will droop and make it difficult to completely solve the problem of channels being formed. Also, the adhesive layer is thinner at the edges of the sheet bundle than the center because of the later cover sheet binding process but adhesive does not bleed out to the cover sheet or backside sheet surfaces when the cover sheet is folded over the sheet bundle. It is impossible to form such an adhesive layer with the conventional blade structure.

The present invention is based on forming an even layer of adhesive while pushing away excess adhesive when forming a predetermined layer of adhesive using a blade. The present invention provides an adhesive applicator that forms adhesive to a smooth surface at a predetermined thickness when it is applied to a sheet bundle edge. There is neither unevenness nor wrinkles in the backside cover sheet when binding the cover sheet and the esthetic appearance of the booklet is maintained. Furthermore, the present invention provides a bookbinding apparatus that can provide a cosmetically acceptable cover when binding a cover sheet to form a booklet, by applying adhesive to the edges of a sheet bundle of varying thicknesses.

SUMMARY OF THE INVENTION

The present invention employs the following configuration to solve the aforementioned problems. A sheet bundle holding means, such as gripping means, holds the sheet bundle at a predetermined adhesive application position. An adhesive container that stores adhesive is disposed at this adhesive application position, and is equipped with an applicator roller means, and a scraper blade that adjusts the thickness of the layer of adhesive applied by that roller means. Moving means are equipped that drive the applicator roller means or the sheet bundle holding means so that the applicator roller means and scraper blade move relative to the sheet bundle. The scraper blade is configured to push or sweep away excess adhesive from one end of the sheet bundle to the other end across the backside thereof.

Accordingly, the scraper blade forms a smoothly finished surface of adequately softened and flow-able adhesive, at the same time as removing excess adhesive. Therefore, the cover sheet can be folded over the backside of the sheet bundle at the binding process without unevenness, thereby providing a sharply defined and well finished booklet and cover. The scraper blade forms a predetermined gap with the backside edge of the sheet bundle, and is composed of a plate-shaped member set at a predetermined angle with regard to the backside of the sheet bundle to push away excess adhesive from one end of the backside to the other end. It is possible to attain that affect with a simple structure.

The adhesive application means and scraper blade have a compact and comparatively simple structure by fastening the adhesive application means and allowing the scraper blade to move, and by enabling the adhesive container to move along the backside of the sheet bundle. The adhesive container moves by equipping an adhesive container moving means that reciprocates the container. Also, a predetermined gap is formed between scraper blade and backside of the sheet bundle, and the scraper blade gradually narrows toward an edge of the sheet bundle Sa to push away excess adhesive. This enables the forming of an adhesive layer beyond what is required at the edge of the sheet bundle without the adhesive bleeding out when the cover sheet is folded. On the other hand, the same effect is attained even if a projection is formed on the scraper blade near a sheet bundle edge to push away excess adhesive.

The scraper blade is disposed oblique to the direction of adhesive container movement. Specifically, it is oblique to the adhesive application means at a predetermined angle with regard to the backside of the sheet bundle in order to cause the pushed-away excess adhesive to drop into the adhesive container. Therefore, the cooled excess adhesive is not able to lower the temperature of the adhesive adhering to the applicator roller when it drops back into the container. Note that the scraper blade is composed of a flat, plate-shaped member, and its plate-shaped knife edge portion forms an application gap with the backside edge of the sheet bundle. The knife-edge portion forms a level that gradually narrows toward the bottom surface therebetween the edge portion so that the excess adhesive is securely pushed away and quickly drops into the adhesive container.

The bookbinding apparatus of the present invention is equipped with a sheet stacking unit that collects sheets into a bundle, an adhesive applicator that applies adhesive to an edge of the sheet bundle from the sheet stacking unit, cover sheet binding means that binds a cover sheet to the backside of the sheet bundle from the adhesive applicator device, and a cover sheet folding means that folds the cover sheet over the sheet bundle positioned at the cover sheet binding means. The adhesive applicator is configured as described above.

Because the blade is configured to sweep away excess adhesive from one edge across the backside of the sheet bundle to the other to adjust the adhesive applied by the applicator roller means to a predetermined thickness, the backside can be finished with a smooth cover without unevenness in shape at the cover binding process. Specifically, even if a portion of the adhesive layer droops downward or channels are formed because of the shape of the applicator roller or the viscosity of the adhesive, the action of the blade to sweep away excess adhesive fills in any indentations and smoothes over blemishes to form the desired thickness and shape. Therefore, the backside can be finished to a smooth and proper shape at the cover sheet binding process.

Also, because the scraper blade is set to a predetermined angle for the flow of the excess adhesive, the structure is simple. It is possible to apply adhesive with the applicator roller and remove excess adhesive with a simple structure if the structure moves a blade along the backside of the sheet bundle in the same unit as the adhesive application means.

Note that while the scraper blade sweeps away excess adhesive, that excess adhesive is cooled by the blade angled away from the applicator roller means. The comparatively lower-temperature adhesive falls near the applicator roller means but does not reduce the temperature of the adhesive on the applicator roller. Also, a projection is provided on an edge of the blade that sweeps the excess adhesive, causing the gap therebetween the sheet bundle edge to be narrower. Therefore, there is no bleeding of the adhesive from the edge when the cover sheet is folded.

DETAILED DESCRIPTION OF THE EMBODIMENTS

Figure 1:
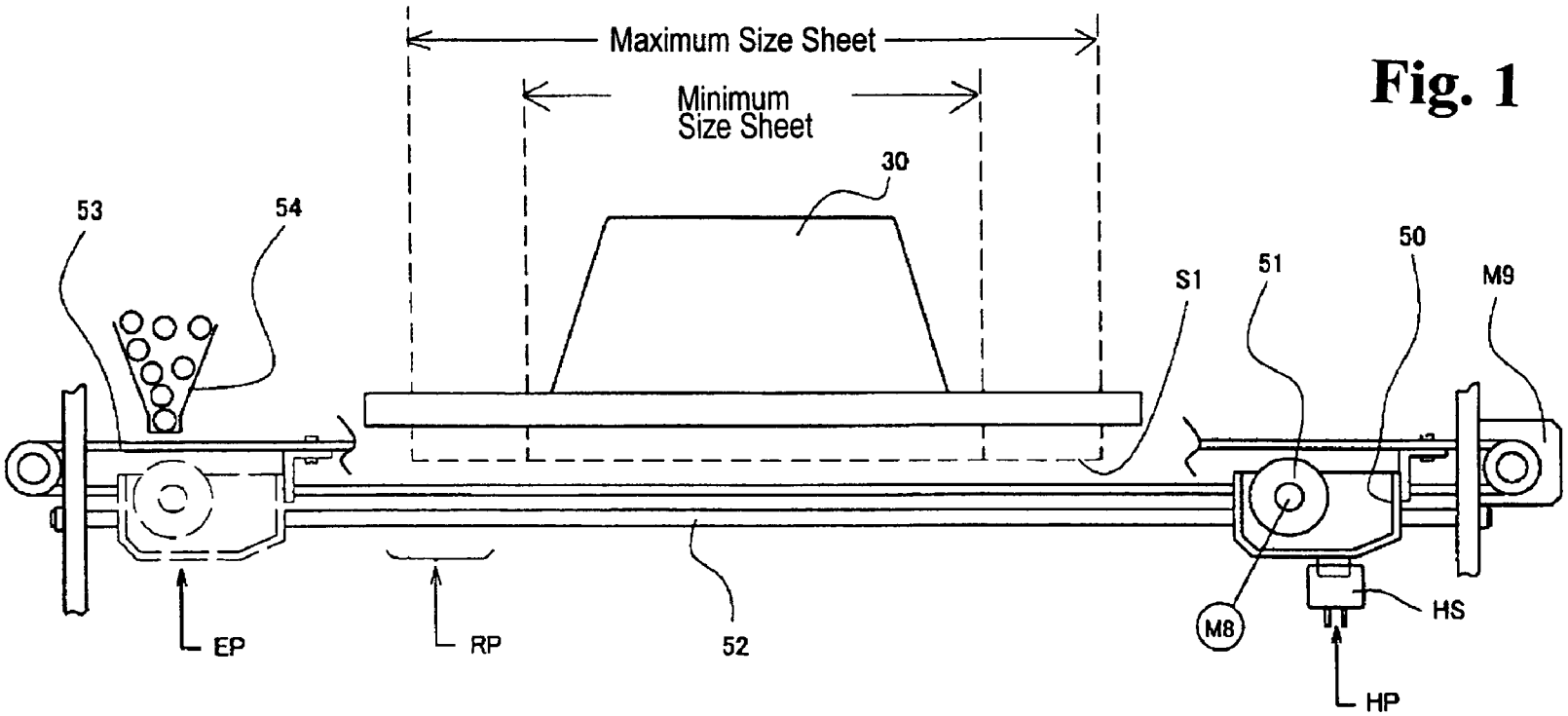
FIG. 1 is an explanatory drawing of the overall structure of an adhesive applicator according to the present invention.
Figure 2:
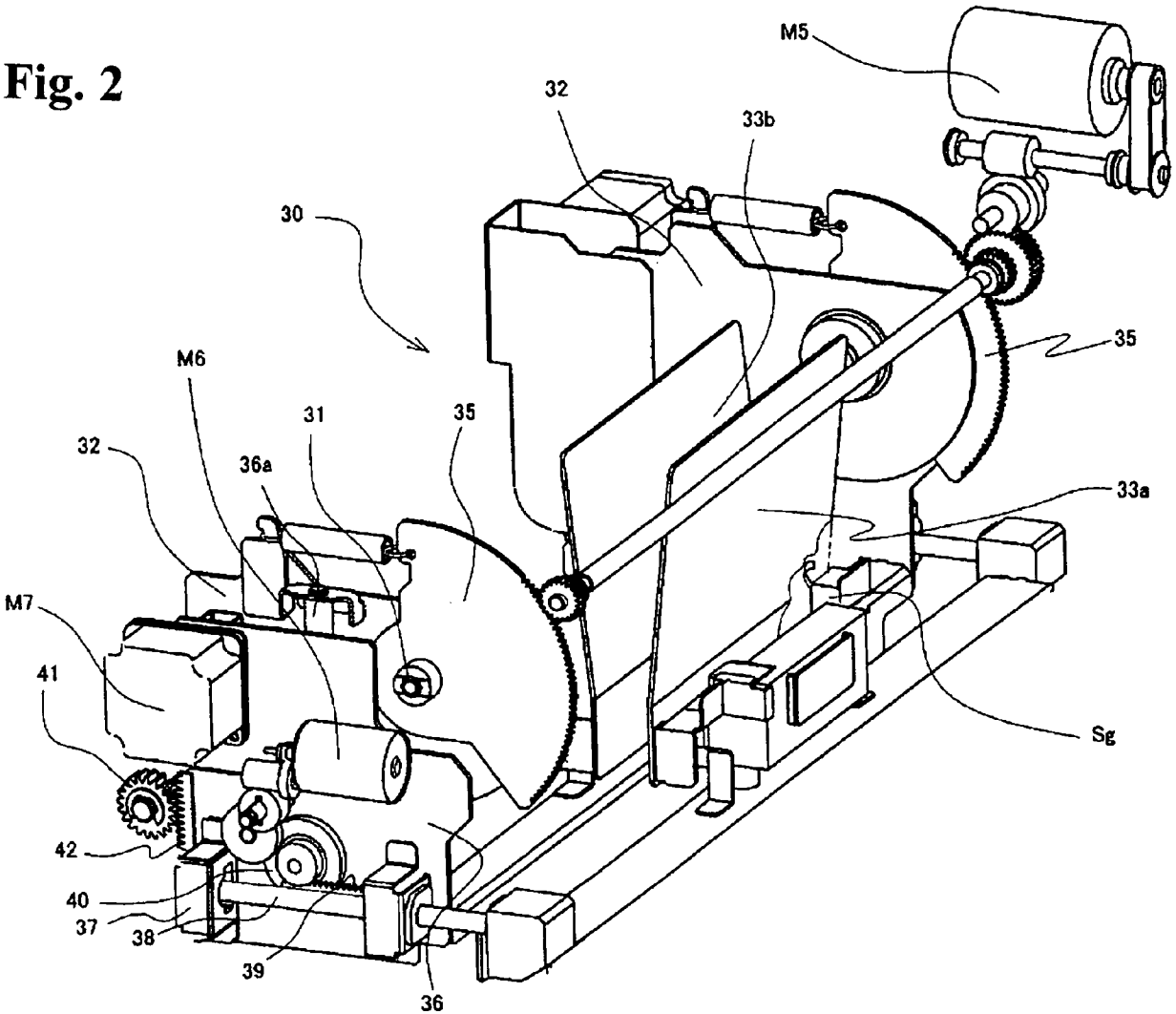
FIG. 2 is a perspective view of a sheet holding means (sheet bundle holding means) of the apparatus of FIG. 1.
Figure 3:
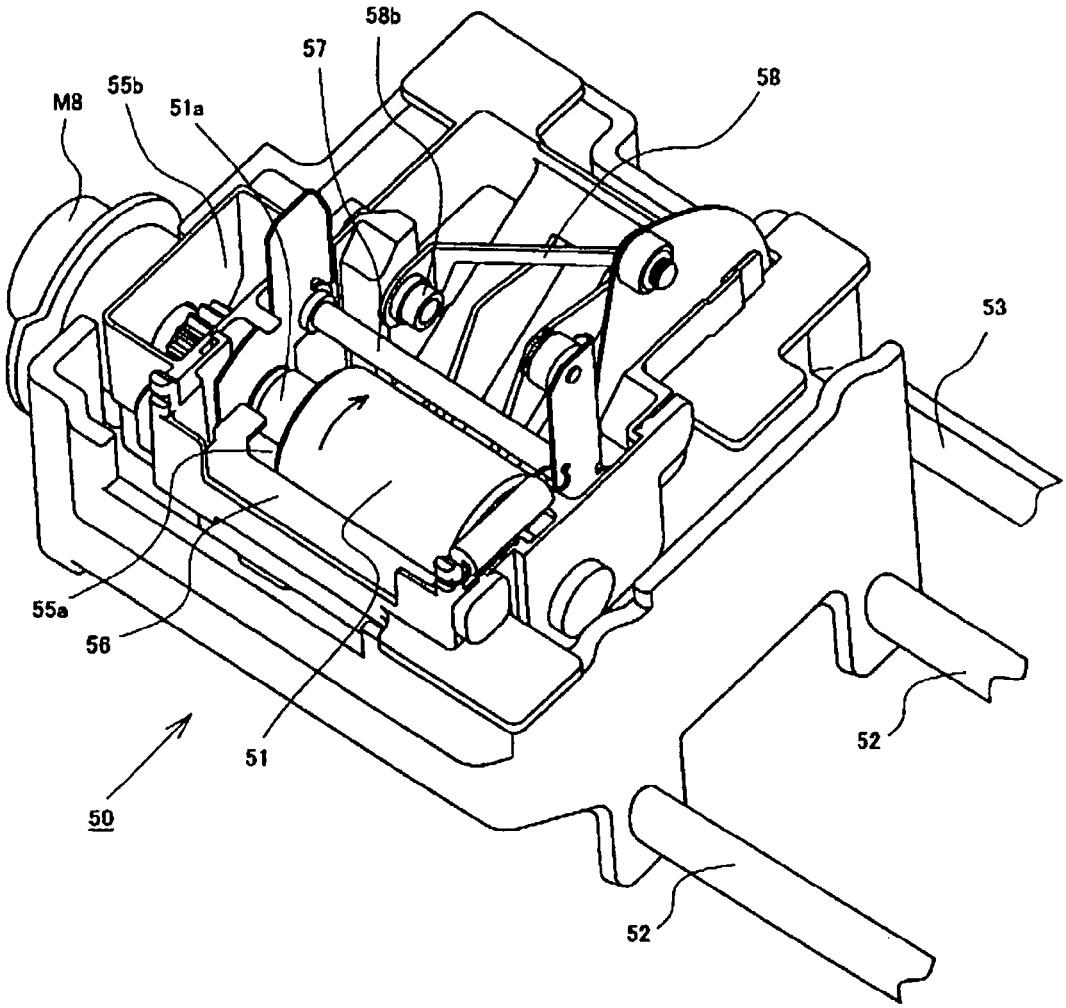
FIG. 3 is a perspective view of an adhesive applicator unit according to the present invention.

Preferred embodiments of the present invention will now be explained with reference to the drawings provided. FIG. 1 shows a configuration of the adhesive applicator unit; FIG. 2 is a perspective view of a sheet bundle holding unit; FIG. 3 is a perspective view of the adhesive applicator unit.

The adhesive applicator unit E of the present invention is composed of a sheet bundle holding means 30 that holds a sheet bundle at a predetermined posture, as shown in FIG. 1; applicator roller means 51 that applies adhesive to the edge (bottom edge) S1 of the sheet bundle held by the sheet bundle holding means; and an adhesive container 50 that incorporates the roller means. The sheet bundle holding means 30 holds the sheet bundle Sa at horizontal, vertical or other predetermined postures. The drawings show the means composed of a gripper mechanism that grips a sheet bundle Sa by a fixed clamper 33*b* and a movable clamper 33*a*. In the drawing, the sheet bundle Sa is held in a substantially vertical posture. The applicator roller means 51 is built-in to the adhesive container 50 to move along a bottom edge S1 of the sheet bundle.

The adhesive container 50 is composed of a tub that stores hot-melt adhesive, and the applicator roller means 51 is mounted to a rotating shaft 51*a* axially supported at the side walls of the container. Thus, with this configuration, adhesive is applied to the bottom edge S1 of the sheet bundle Sa by the sheet bundle Sa or the applicator roller means 51 moving relative to the other. In the drawing, the applicator roller means 51 is configured to move along the bottom edge S1 of the sheet bundle Sa. Although the drawings show a configuration where the adhesive container 50 and the applicator roller means 51 incorporated therein move along the bottom edge S1 of the sheet bundle Sa, it is also acceptable for the adhesive container 50 to be longer than the length of the bottom edge of the sheet bundle Sa and to reciprocate the applicator roller means 51 inside the container, but.

For that reason, the adhesive container 50 is slidably supported on a guide rail 52 disposed on the apparatus frame, and is connected to a timing belt 53 equipped with a drive motor M9. The drive motor M9 and timing belt 53 comprise the moving means of the applicator roller means 51. A home position HP sensor HS detects the home position of the adhesive container 50 to control the drive motor M9.

The adhesive container 50 will now be described with reference to FIG. 3. The adhesive container 50 is formed into a tub shape comprising a synthetic resin. In the drawing, the container is separated into an adhesive storage tank 55*a* and an adhesive filler tank 55*b*. Solid adhesive is charged to the adhesive filler tank 55*b* and melted by a heater, not shown. The melted adhesive then flows to the adhesive storage tank 55*a*. The applicator roller means 51 is rotatably supported by a rotating shaft 51*a* in the adhesive storage tank 55*a*, and a drive motor M8 is connected to the rotating shaft 51*a*. The applicator roller means 51 is formed by a heat-proof and impregnable rubber material that absorbs adhesive on the inside and forms an adhesive layer on the outside. A doctor blade 56 comprising a plate-shaped member forms a predetermined gap with the external circumference of the roll operable to adjust the layer of adhesive on the external circumference of the roller to a fixed amount at the upstream side in the direction of rotation.

Figure 4:
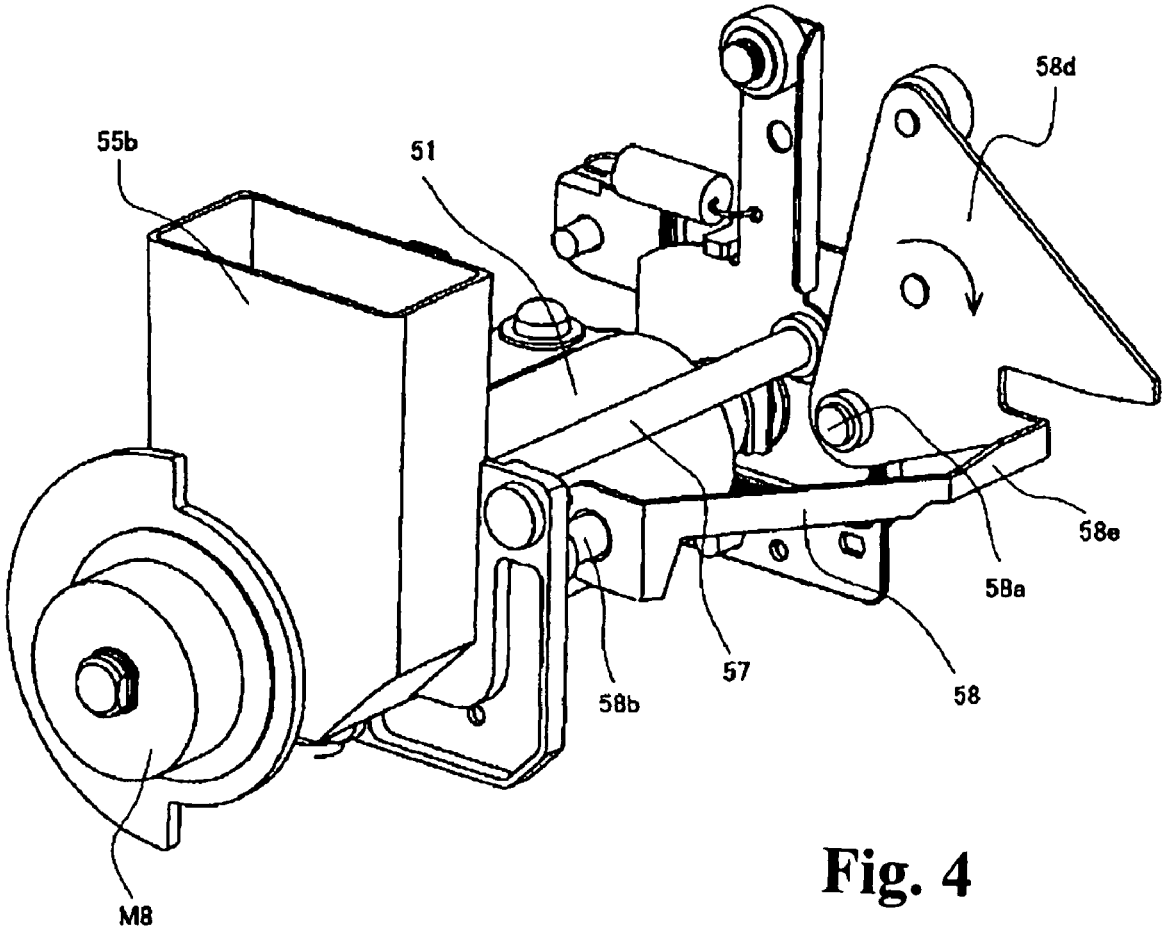
FIG. 4 is a perspective view of a portion of the apparatus of FIG. 3.

A dam-wall member 57 disposed at a downstream side in the direction of roller rotation dams the layer of adhesive on the external circumference of the roller. Therefore, the layer of adhesive on the external circumference of the applicator roller means 51 rotated by the drive motor M8 in the clockwise direction of FIG. 3, is adjusted to a fixed thickness. A layer of adhesive thus accumulates at the application unit positioned at the uppermost position of the roller and the dam-wall member 57 of a downstream side thereof. A scraper blade 58 is disposed on the adhesive container 50 to remove excess applied adhesive from the bottom edge S1 of the sheet bundle Sa. The applicator roller means 51 is shown in FIG. 3 to be disposed at a distance above the adhesive storage tank 55*a*. As shown in FIGS. 3 and 4, the scraper blade 58 is born by shafts 58*a*, 58*b* on both side walls of the adhesive container 50. The scraper blade 58 comprises a plate-member having a knife edge 58*c* arranged to a predetermined angle across the back of the bottom edge S1 of the sheet bundle Sa. The lever-shaped side wall 58*d* is integrally formed with the scraper blade 58 and rocks around the shafts 58*a*, 58*b* to an actuated position of FIG. 3 and a non-actuated position that is lower from the actuating position according to the position of the sheet bundle holding means 30.

As the applicator roller means 51 moves along the bottom edge S1 of the sheet bundle Sa supported by the sheet bundle holding means 30, an adhesive layer formed around the external circumference of the applicator roller means 51 is applied to the bottom edge S1. The applicator roller means 51 reciprocates between a home position HP shown in FIG. 5(*a*), and a return position RP at the final edge of the sheet bundle Sa. In the advancing direction (specifically from HP to RP), the applicator roller means 51 is controlled to firmly touch the sheet bundle Sa, thereby causing the sheets at the bottom edge S1 of the sheet bundle Sa to separate somewhat so that adhesive can be securely applied between the sheets.

Figure 5A:
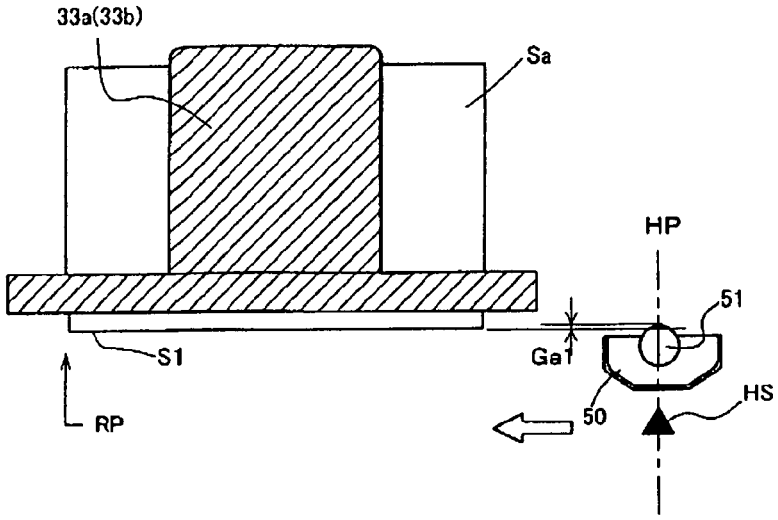
FIGS. 5(*a*) to 5(*c*) are a conceptual views of an adhesive application means in the apparatus of FIG. 1, wherein FIG. 5(*a*) shows a state of container advancing movement, FIG. 5(*b*) shows the positional relationships of the sheet bundle and adhesive container, and FIG. 5(*c*) is a sectional view of FIG. 5(*a*)
Figure 5C:
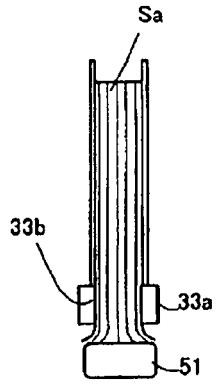
Figure 5B:
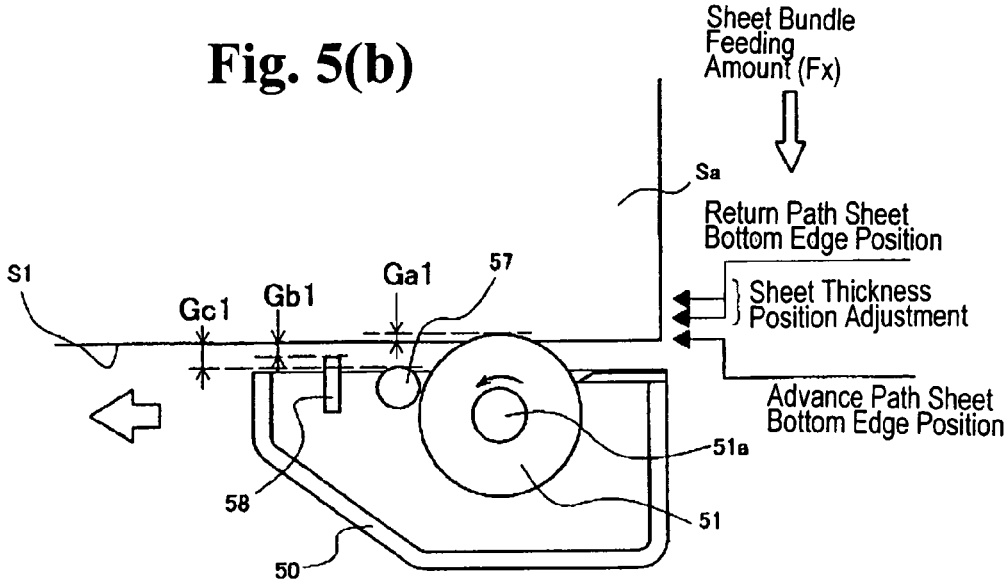
Figure 6A:
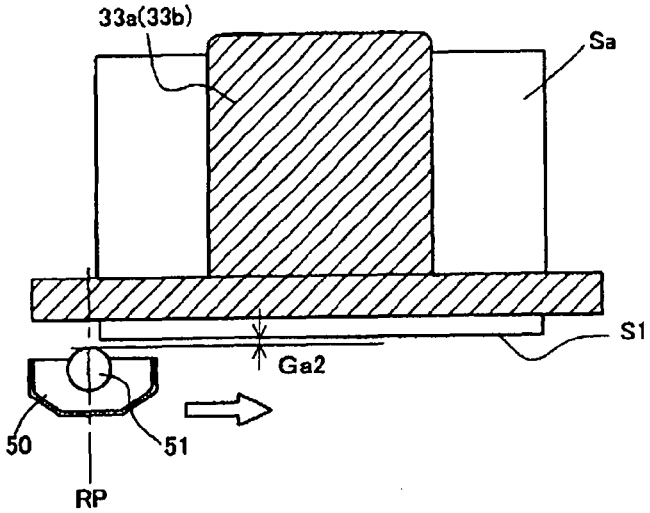
FIGS. 6(*a*) to 6(*c*) are conceptual views of an adhesive application means according to the apparatus of FIG. 1, wherein FIG. 6(*a*) depicts a state of container return movement, FIG. 6(*b*) depicts the positional relationships of the sheet bundle and adhesive container, and FIG. 6(*c*) depicts a sectional view of FIG. 6(*a*)
Figure 6C:
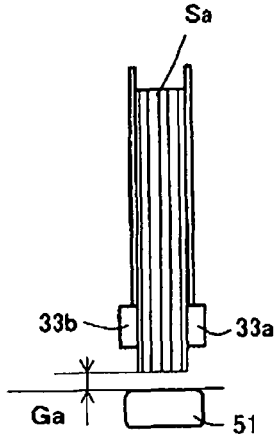
Figure 6B:
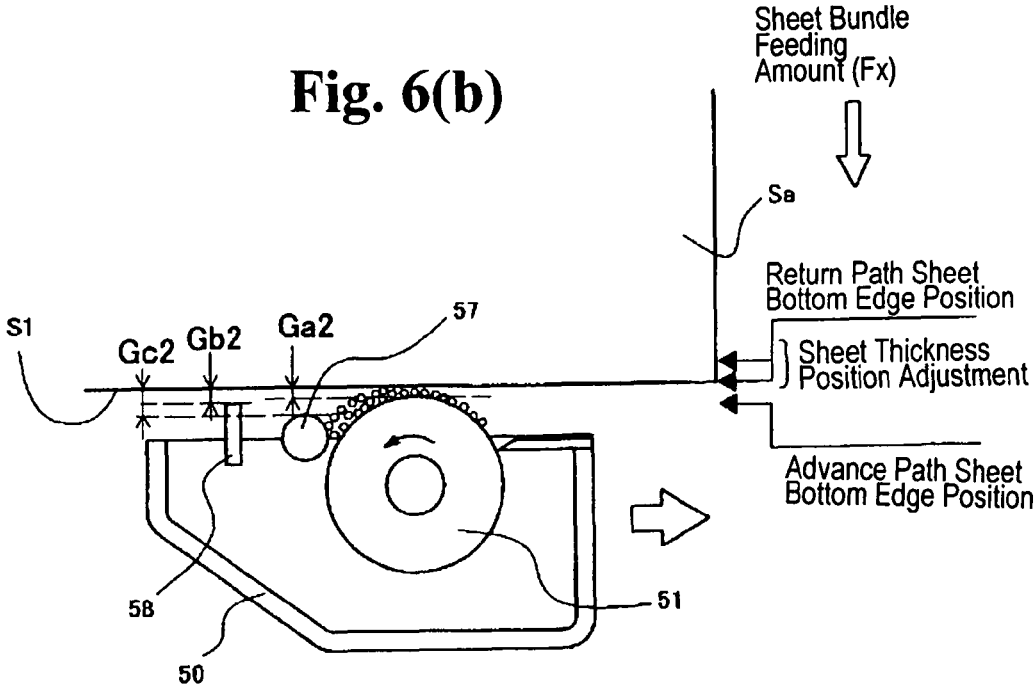
Figure 7A:
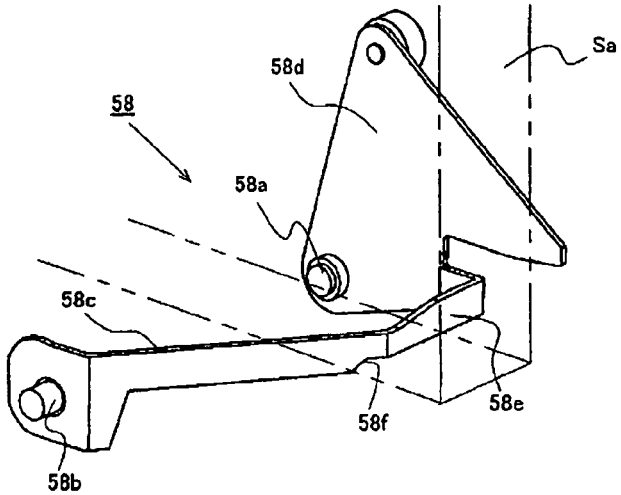
FIGS. 7(*a*) to 7(*d*) are explanatory views of operations of a scraper blade according to the apparatus of FIG. 4, wherein FIG. 7(*a*) shows the arrangement of the sheet bundle and scraper blade, FIG. 7(*b*) shows the operation of the scraper blade, FIG. 7(*c*) shows a different blade shape than the scraper blade shown in FIG. 7(*b*), and FIG. 7(*d*) shows the arrangement of the scraper blade.
Figure 7B:
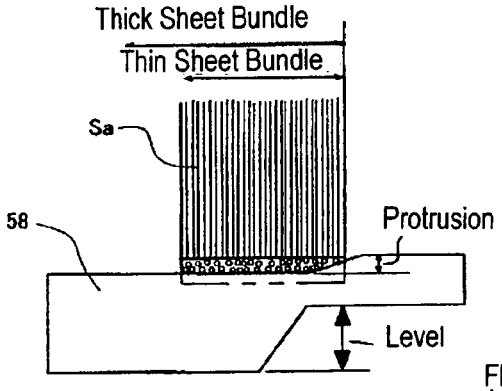
Figure 7C:
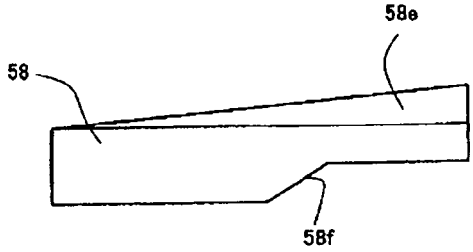
Figure 7D:
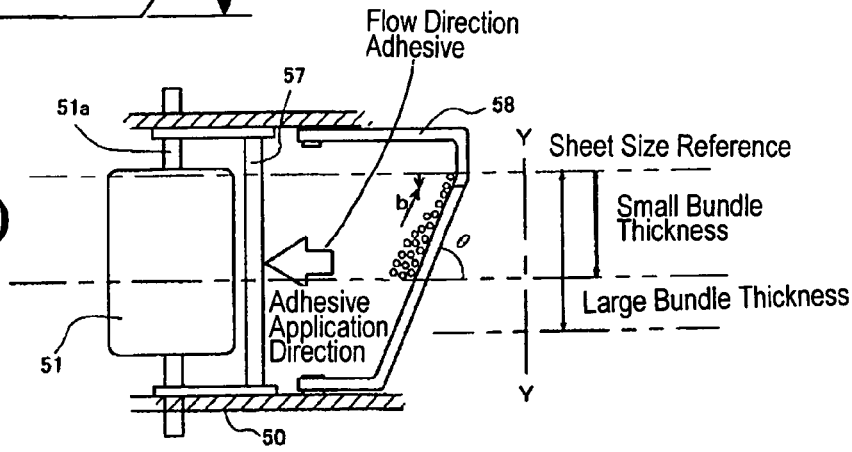

Adhesive is also applied in the return direction (specifically RP to HP). A gap Ga1 is set between the top (application portion) of the applicator roller means 51 and the bottom edge S1 of the sheet bundle Sa so that the roller side is high in the advancing direction as shown in FIG. 5(*a*), and the bottom edge S1 of the sheet bundle Sa is low (Ga1<0), causing the sheets at the bottom edge S1 of the sheet bundle Sa to become somewhat separated as shown in FIG. 5(*c*). Also, a gap Ga2, as shown in FIG. 6(*a*), is set to separate the top (application portion) of the applicator roller means 51 and the bottom edge S1 of the sheet bundle Sa a predetermined distance (Ga2>0) in the return direction. Therefore, the bottom edges of the sheets are separated when the applicator roller means 51 moves in the advancing direction, and adhesive is applied to the bottom edge S1 of the sheet bundle Sa in the return direction.

It is possible for the dam-wall member 57 and scraper blade 58 to move with different positions in the advancing and returning directions of the adhesive container 50. The gap Gc between the bottom edge S1 of the sheet bundle Sa and the dam-wall member 57 and the gap Gb of the scraper blade 58 are adjusted to be wide in the advancing direction and shallow in the returning direction. For that reason, the bottom edges (clampers 33*a*, 33*b*) of the sheet bundle holding means 30 touch the lever-shaped side wall 58*d*, thereby rocking the scraper blade 58 supported by the shafts 58*a*, 58*b* on the adhesive container 50 in the direction of the arrow in FIG. 4. This lowers the scraper blade 58 to a position separated from the bottom edge S1 of the sheet bundle Sa, as shown in FIG. 5(*b*), thereby forming the gap Gb1. In the same way, the dam-wall member 57 rocks in the direction of the arrow around the rotating shaft 51*a* of the applicator roller means 51, thereby moving below the bottom edge S1 of the sheet bundle Sa to form a gap Gc1.

In the return direction, the adhesive container 50 moves to a position where the bottom edge of the sheet bundle holding means 30 has risen (the clampers 33*a*, 33*b* have risen). A gap Gb2 (<Gb1) of the scraper blade 58 is set to a predetermined value separated from the doctor blade 56 and dam-wall member 57. The gap Gc2 (<Gd1) of the dam-wall member 57 is set to a predetermined value. The relationships of the applicator roller means 51, dam-wall member 57, and scraper blade 58 are set to predetermined values, Ga2>0>Ga1, Gb2<Gb1, and Gc2<Gc1; at this time Ga2>Gb2.

Specifically, the gap Ga2 is formed between the top of the roller and the bottom edge S1 of the sheet bundle Sa so that adhesive is securely applied to bottom edge S1 of the sheet bundle Sa. A gap Gb2, which is smaller than Ga2, is formed between the bottom edge S1 of the sheet bundle Sa and the scraper blade 58 knife edge 58*c*. As shown in FIG. 7(*d*), the knife edge 58*c* is disposed at a predetermined angle (θ) with regard to the back (Y-Y in the drawing) of the bottom edge S1 of the sheet bundle Sa. Therefore, the scraper blade 58 forms an adhesive layer of a thickness Ga2 applied to the bottom edge S1 of the sheet bundle Sa by the applicator roller means 51 to a thickness of Gb2. The excess adhesive wiped away by the knife edge 58*c* is pushed off and removed in the direction of the arrow b in FIG. 7(*d*).

By pushing off this excess adhesive, no indentations are formed when sweeping the adhesive with the knife edge 58*c*. Furthermore, any indentations that were formed are filled in by adhesive that is pushed over them, thereby forming a flat and even level of adhesive on the surface of the sheet edges. Note that a projection 58*e* is formed at an edge surface on one side of the sheet bundle Sa side of the knife edge 58*c*. There is tendency for the adhesive on the edge of the sheet bundle to droop downward because of the surface tension. This projection prevents adhesive from exuding out or bleeding when a cover sheet is folded. Therefore, although not shown in the drawing, it is acceptable for the scraper blade 58 to form a gap that gradually narrows toward the sheet bundle side edge to push excess adhesive.

The angle θ of the scraper blade 58 is set to a direction away from the applicator roller means 51 so that excess adhesive is pushed off, as shown in FIG. 7(*d*). A level 58*f* is formed that narrows the width of the edge that pushes excess adhesive away on the opposite, bottom edge of the knife-edge 58*c*. The knife edge 58*c* causes the swept-away, excess adhesive to quickly drop into the container. This prevents adhesive from adhering to the blade and hardening later.

Figure 8:
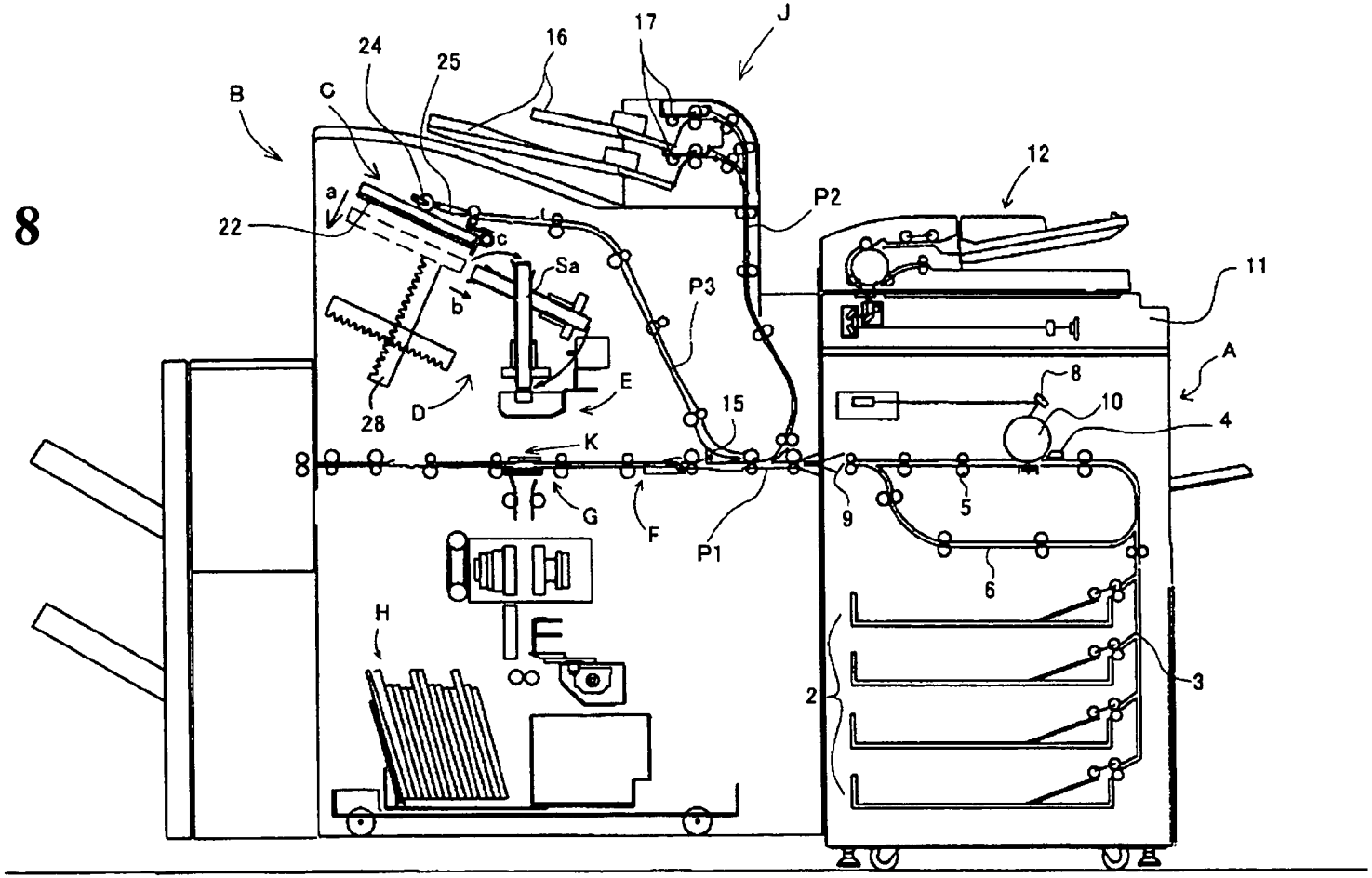
FIG. 8 shows the overall configuration of an image forming system equipped with the bookbinding apparatus of the present invention.

A bookbinding apparatus B that incorporates the adhesive applicator unit E described above is explained with reference to FIG. 8. The bookbinding apparatus B is connected to an image forming apparatus A, such as the one shown in the same drawing. The bookbinding apparatus aligns sheets formed with images at image forming apparatus A into a sheet bundle, then applies adhesive to the backside of the sheet bundle Sa. A cover sheet is then joined to and pressed against the backside of the sheet bundle Sa thereby forming a booklet by that apparatus. The cover sheet is supplied from the image forming apparatus or an inserter device from a direction that intersects the sheet bundle conveyance path. FIG. 8 illustrates such an image forming apparatus. The following will now explain the image forming apparatus A and bookbinding apparatus B.

The image forming apparatus A is incorporated into a system comprising a computer, a word-processor, and the like. The surfaces of documents in a series are printed, and the documents are discharged from a discharge outlet 9. A laser, ink-jet or offset printing method can be adopted as printing means in the image forming apparatus A. FIG. 8 illustrates a printing drum 10, such as an electrostatic drum; a paper feed cassette 2 that feeds sheets to the printing drum 10; a print head 8, such as a laser, to form images on the printing drum 10; a developer 4; and a fixer 5. Sheets of a predetermined size are feed from the paper feed cassette 2 to the sheet supply path 3. The printing drum is disposed in this path 3. An electrostatic latent image is formed by the print head 8 on the printing drum 10, and the developer adheres toner ink to the latent image. After the toner image formed on the printing drum 10 is transferred to a surface of the sheet, it is fixed thereto by the fixer 5, and the sheet is then discharged from the discharge outlet 9.

A turn-over path 6 is a duplex path for printing to a back surface of a sheet by turning over the sheet printed with an image, from front to back and guiding it to the printing drum 10 again. The image reading apparatus 11 is composed of a platen that supports a placed original sheet; a scanning carriage that reciprocates along the platen; and photoelectric conversion elements, such as a CCD, photo-electrically convert original images scanned by the scanning carriage. The original feeder device 12 is equipped with a tray that sets originals; a conveyance path that guides originals from the tray to the platen; and a discharge tray so that the feeder device can automatically supply originals to the platen. Data of the original read by the image reading apparatus is transferred to the data storage unit at the print head 8. The data storage unit is connected to an external device such as a computer, word-processor or the like, and receives original data from the external device.

The bookbinding apparatus B is composed of a stacking tray unit C that stacks in page order sheets sequentially conveyed from the discharge outlet 9 of the image forming apparatus A and aligns the sheets into a sheet bundle; a bundle conveyance unit D that conveys the sheet bundle from the tray unit along the bookbinding path; an adhesive applicator unit E disposed at a predetermined adhesive application position in the bookbinding path to apply adhesive to a back edge of the sheet bundle; a cover sheet conveyance unit F that supplies and sets a cover sheet at a binding position disposed at a downstream side of the adhesive application position; a binding unit G disposed at a binding position to join the cover sheet and sheet bundle; and a storage stacking unit H that stores the finished sheet bundle booklet. The adhesive applicator unit E is composed of the adhesive applicator E described above.

Stacking Tray Unit

As shown in FIG. 8, a sheet conveyance in path P1 is connected to the discharge outlet 9 of the image forming apparatus A described above. This sheet conveyance in path P1 is disposed substantially horizontally, and is composed of a path that traverses the center of the apparatus. A paper feed path P2 of the inserter J (described below) that feeds the cover sheet and the center binding sheet conveyance path P3 that conveys sheets from the image forming apparatus are connected to the sheet conveyance in path P1. A path switching flapper 15 is disposed at the path branching point. The center binding sheet conveyance path P3 is disposed to guide sheets from the sheet conveyance in path P1 disposed in the center of the apparatus, to above the apparatus; a discharge roller (sheet conveyance means) and sheet sensor Se are disposed at the discharge outlet 20.

The stacking tray 22 is disposed at a downstream side of the center binding sheet conveyance path P3 to form a level below the discharge outlet 20. A sheet guide 25, aligning roller 24, and a trailing edge aligning member 23 that aligns the positions of the trailing edges of the sheets are disposed at the stacking tray 22. The sheet guide 25 is composed of a guide member that guides sheets from the discharge outlet to the top of the stacking tray 22; the aligning roller 24 conveys sheets advancing in to the tray along the sheet guide 25 to the discharge direction (the left direction of FIG. 9). After the trailing edge of the sheet advances into the tray, the sheet is switched back in the opposite direction (the right direction in FIG. 9). The trailing edge of the sheet is aligned by striking the trailing edge aligning member 23. The aligning roller 24 is connected to a drive motor M2 capable of both forward and reverse rotation. The sheet guide 25 is rockably configured to guide sheets from the discharge outlet to the stacking tray 22 when sheets are switched back and engage the trailing edge aligning member 23. A drive means, such as an actuating solenoid, not shown, is connected to the sheet guide 25.

Aligning means, not shown, that aligns the crosswise direction of sheets is equipped on the stacking tray 22. The aligning means is disposed to move a pair of aligning plates (for example on the left and right sides) to align sheets to a sheet side or to a center of the tray. At least one of the aligning plates is reciprocated by a drive motor. Although the stacking tray 22 may be fastened to the apparatus frame, non-limiting, the drawing illustrates the stacking tray moveably mounted to the apparatus frame so as to move up and down between the stacking position and the conveyance position of FIG. 8. A gear rack 28 equipped on a side of the tray is mated to a pinion 27 connected to a tray raising motor M4. The forward and reverse drives of the motor M4 raise and lower the stacking tray 22 between the stacking position (solid lines in FIG. 8) and the conveyance position (broken lines). Therefore, sheets stacked on the stacking tray 22 are lowered in the direction of the arrow a from the stacking position, move in the direction of the arrow b, and are then transferred to the sheet bundle holding means 30.

A thickness detection means St is disposed that detects the thickness of the sheet bundle stacked on the stacking tray 22. The detection means detects the position of the gripper that grips the sheets on the stacking tray 22 using a slidac sensor, for example, and detects the thickness of the sheet bundle from the resistance value. The sheet thickness detection means St detects the thickness of a sheet bundle stacked on the stacking tray 22. (1) The gap Ga 2 between the adhesive applicator roll and sheet bundle described below is set to correspond to the thickness of the sheet bundle. (2) The setting position of the cover sheet is adjusted to correspond to the amount of feed for the cover sheet and the thickness of the sheet bundle, and is used for subsequent processes such as aligning the sheet bundle Sa to the center of the cover sheet. Therefore, the thickness detection means can adopt a variety of thickness detection methods such as counting the number of sheets using the sheet sensor Se of the discharge outlet 20 and by multiplying the average thickness of a sheet.

Bundle Conveyance Unit

The bundle conveyance unit D conveys a sheet bundle Sa from the stacking tray 22 to the downstream side adhesive application position and comprises the sheet bundle holding means 30 as shown in FIG. 3. The conveyance means is disposed at the bookbinding path P5 disposed to longitudinally traverse the apparatus. This means deviates the sheet bundle received in a substantially horizontal posture from the stacking tray 22 to a substantially vertical posture by rotating 90 degrees, and conveys the sheet bundle to the adhesive application position at the downstream side. For that reason, the sheet bundle holding means 30 is composed of a pair of clampers 33*a*, 33*b* that grip the sheet bundle Sa, and a unit frame 32 that is equipped with both clampers. Also, this unit frame 32 is rotatably supported on the apparatus frame by the shaft 31. By rotatingly driving the fan-shaped gear 35 equipped on the shaft 31 by the motor M5 equipped on the apparatus frame, the unit frame 32 revolves in the clockwise direction and counterclockwise direction of FIG. 2.

A movable frame 36 is matingly supported to move in up and down directions on the guide rail 36*a* (a portion thereof shown in FIG. 2) disposed on the unit frame 32 rotatably born on the apparatus frame. The pinion 41 connected to the elevator motor M7 equipped on the unit frame 32 and the gear rack 42 equipped on the movable frame 36 are mated. The pair of clampers 33*a*, 33*b* on the movable frame 36 is mounted in the following way. The fixed side clamper 33*b* is fastened to the left and right side frames that comprise the movable frame 36 at a width size to grip sheets. A rod 38 is disposed on the movable side clamper 33*a*, and is matingly supported by the bearing 37 on the movable frame 36. A pinion of the grip motor M6 is matingly connected to the gear rack 39 integrally formed with the rod 38.

Therefore, the clampers 33*a*, 33*b* execute the gripping operation to grip the sheet bundle Sa by the grip motor M6. The motor M5 deviates the gripped sheet bundle Sa from a horizontal posture to a vertical posture, then the elevator motor M7 moves the vertically arranged sheet bundle to the downstream adhesive applicator position along the bookbinding path P5. The grip end sensor Sg disposed on the movable clamper 33*a* detects whether the sheet bundle Sa has been securely gripped with the predetermined pressure. When the movable clamper 33*a* is moved in the clamping direction to grip the sheet bundle Sa by the drive motor M6, it approaches the fixed clamper 33*b* thereby gripping the sheet bundle Sa. When gripped, the gripping sensor Sg turns ON and the grip motor M6 drives a predetermined amount after that signal. This causes the movable clamper 33*a* to further approach the fixed clamper 33*b* while overcoming an urging spring, not shown, when the sheet bundle Sa is gripped, and stops to enable the sheet bundle Sa to be gripped at a predetermined pressure. In this state, the sheet bundle holding means 30 is moved downward in FIG. 9 by the elevator motor M7 while gripping the sheet bundle and moves the sheet bundle Sa to the downstream to the adhesive application position X.

Adhesive Application Unit

The sheet bundle Sa is conveyed by the bundle conveyance unit D. The adhesive applicator unit E, using the configuration described above, applies adhesive to the bottom edge S1 of the sheet bundle Sa held at the adhesive application position X. The sheet bundle holding means 30 adjusts the amount of adhesive that is applied by varying the sheet bundle feed amount using the elevator motor M7. The adjustment of the amount of adhesive using the feed amount Fx of the sheet bundle is based on the sheet bundle thickness information from the sheet thickness detection means St. If the sheet bundle is thick, the gaps Ga2 and Gb2, explained in relation to FIG. 6 are widened to increase the amount of adhesive. If the thickness is small, the gaps Ga2 and Gb2 are narrowed to reduce the amount of adhesive. By controlling the elevator motor M7 of the sheet bundle holding means 30, the sheet bundle feeding amount Fx can be adjusted. It is also acceptable to equip roll position adjusting means that move the position of the applicator roller means 51 up or down. When the drive motor M9 moves the container from the operating position where adhesive is applied to the sheet bundle Sa to the idle position EP (see FIG. 1) separated a distance from that position at the idle instruction signal, adhesive is charged to the container from an adhesive tank 54 arranged at the idle position EP.

Inserter Device

A cover sheet is bound to the sheet bundle Sa applied with adhesive at the adhesive application unit E. The feeding of a cover sheet will now be explained. Sheets formed with images are sequentially conveyed to the discharge outlet 9 of the image forming apparatus A. Normally, a discharge sheet stacker is arranged at the discharge outlet 9. According to the present invention, the sheet conveyance path P1 is connected to the discharge outlet 9 for the bookbinding apparatus B, and an inserter J is installed at this sheet conveyance path P1. The inserter J is composed of at least one level of stacking trays 16 for stacking sheets (the drawing shows two tiers of stacking trays 16), pickup means 17 for separating sheets on the stacking tray 17 into single sheets, and a sheet feeding path P2 for guiding a sheet from the pickup means 17 to the sheet conveyance path P1.

Sheets set on the stacking tray 16 are fed from the discharge outlet 9 of the image forming apparatus A to the sheet conveyance in path P1 between sequentially conveyed sheets. In other words, after a series of sheets are formed with images and are conveyed from the image forming apparatus A, the sheets are fed from the stacking tray 16 after the final sheet. Therefore, special sheets such as thick or coated sheets are prepared as cover sheets in the stacking tray 16. A sheet on the stacking tray 16 is conveyed to the sheet conveyance in path P1 at a control signal sent from the bookbinding apparatus B. The reason why there is a two-tiered approach to the stacking trays 16 is that it is possible to prepare different types of cover sheets in advance on the trays. The operator can select the type of cover sheet to bind to the sheet bundle from the selected tray.

Cover Sheet Conveyance Unit

In the system shown in FIG. 8, a sheet feeding path P2 of the inserter J is connected to the sheet conveyance in path P1. The cover sheet is guided to the cover sheet feeding path P4 by the path switching flapper 15. The cover sheet conveyance path P4 intersects the bookbinding path P5. The sheet bundle from the bookbinding apparatus and the cover sheet are joined into an upside-down T shape for binding at the intersecting area (hereinafter referred to as the binding position K). This cover sheet conveyance path P4 is composed by upper conveyance guides 63*a* and 63*b* and a lower conveyance guide 63*c* that oppose each other at a predetermined gap. The upper conveyance guides 63*a* and 63*b* are separated into a first upper conveyance guide 63*a* on the right side and a second upper conveyance guide 63*b* using the bookbinding path P5 as a boundary, wherein the right and left conveyance guides individually open and close.

Registration means for positioning the cover sheet at each position of the conveyance direction and the conveyance right angle direction and cover sheet conveyance means, for conveying a cover sheet positioned by the registration means at the binding position K, are arranged on the cover sheet conveyance path P4. The cover sheet conveyance means is composed of a pair of conveyance rollers disposed on the cover sheet conveyance in path P4. Drive roller 69*a* is mounted on the lower conveyance guide 63*c* and follower roller 69*b* is mounted on the upper conveyance guides 63*a*, 63*b*. A drive motor 10 is connected to the drive roller 69*a*. The upper conveyance guide 63*a*, 63*b* and the follower roller 69*b* are mounted to the apparatus frame by a cam lever, etc., that is capable of moving between a position that touches the drive roller 69*a* and a separated position rising thereabove.

Figure 9:
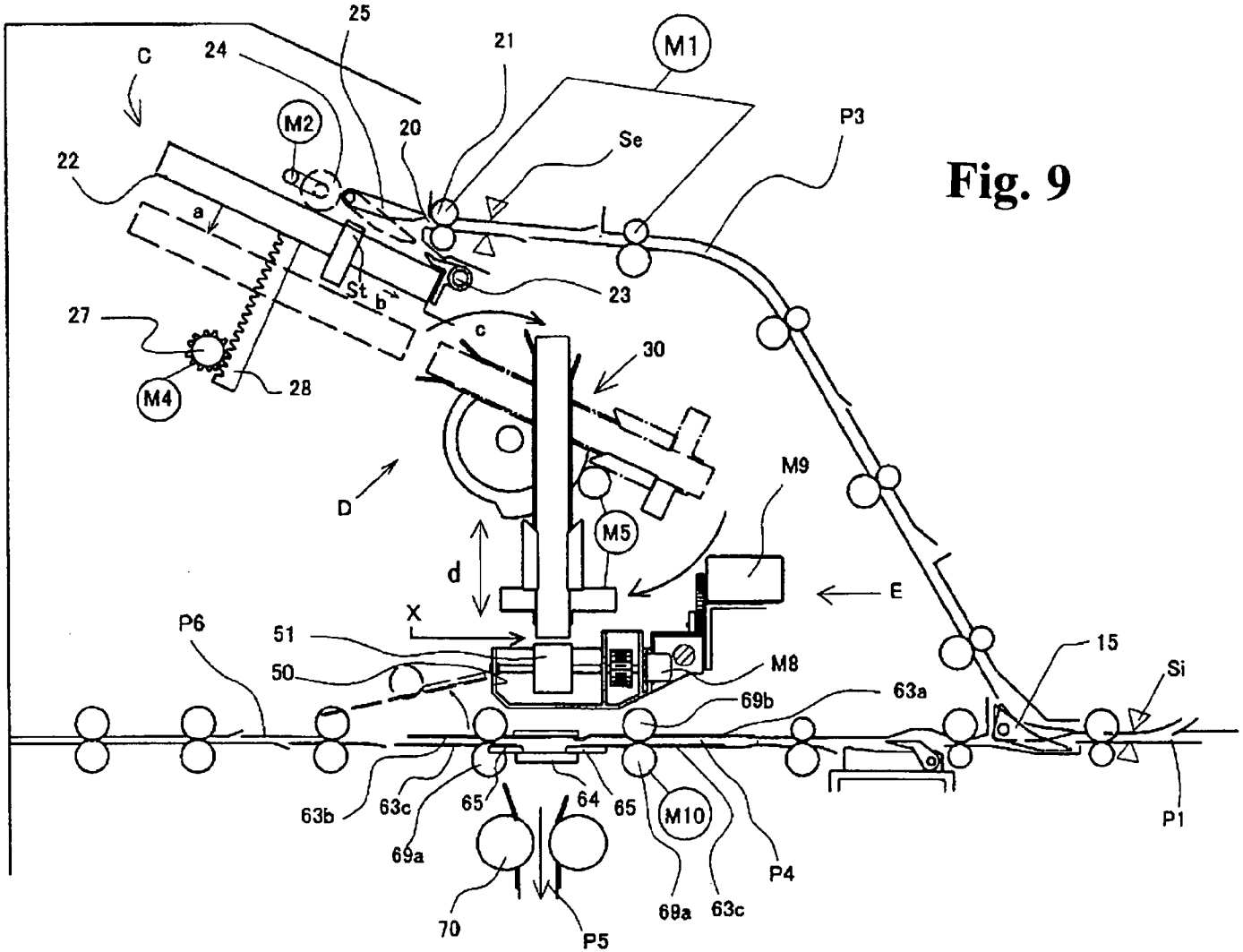
FIG. 9 shows details of the essential portion (bookbinding apparatus) of the apparatus of FIG. 1.
Figure 10A:
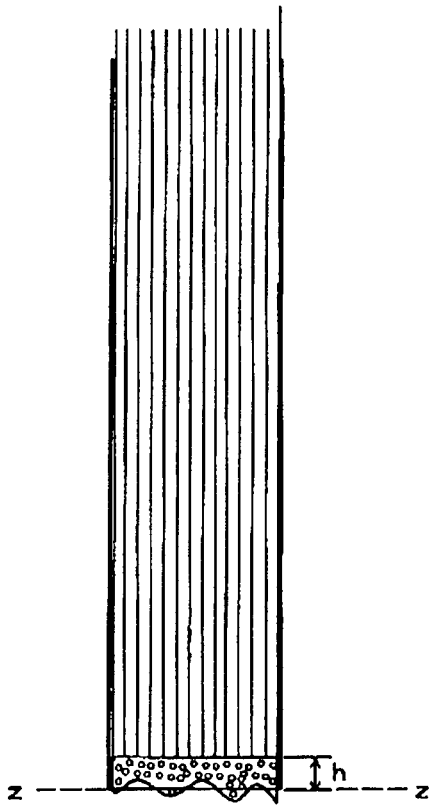
FIGS. 10(*a*) and 10(*b*) are explanatory drawings showing the application of adhesive in a conventional apparatus, wherein FIG. 10(*a*) depicts the shape of the adhesive layer on an edge of a sheet bundle, and FIG. 10(*b*) depicts a state of a backside sheet of booklet.
Figure 10B:
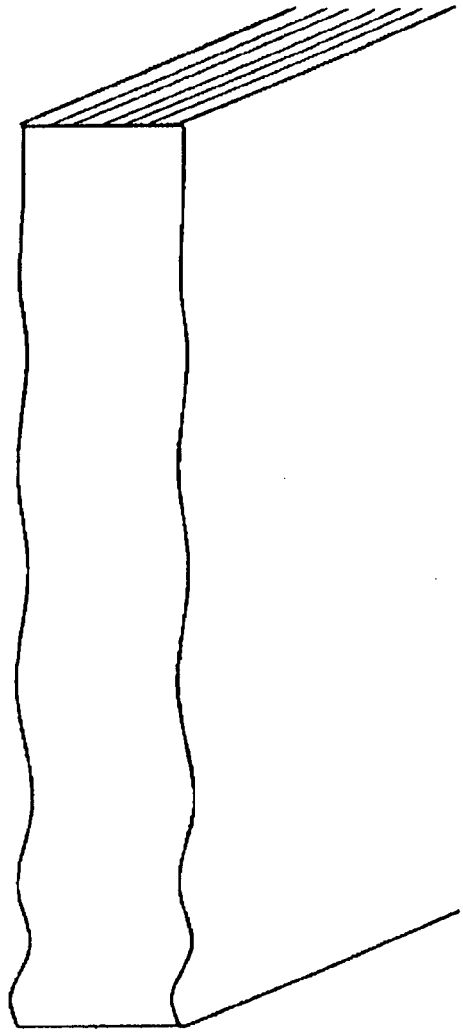

Therefore, the upper conveyance guides 63*a*, 63*b* and the follower roller 69*b* are structured to move between an operating position where they touch a cover sheet in the path by the drive motor of the cam lever, not shown, move the cover sheet to the left side of FIG. 9, and move to a retracted position that rises separated from the cover sheet. In this way, the cover sheet is conveyed to the binding position K at an intersecting point of the cover sheet conveyance path P4 and the bookbinding path P5, and is set at a predetermined position. The upper conveyance guides 63*a*, 63*b* of the binding position K are composed of an opening guide plate. They are configured to move between positions that cover the path and guide the top of the cover sheet, and positions retracted from the bookbinding path P5. Then, after the conveyance guide 63*b* guides the cover sheet, as shown in FIG. 9, it retracts upward to open the bookbinding path P5.

Binding Unit

The cover sheet binding means 64 and cover sheet folding means 65 are disposed at the binding position K. The sheet bundle Sa from the bookbinding path P5 and the cover sheet from the cover sheet conveyance path P4 are joined in an upside-down T-shape. First, adhesive is applied by the adhesive application unit E to the bottom edge S1 of the sheet bundle gripped by the sheet bundle holding means 30 at the bookbinding path P5, and the adhesive container 50 is then retracted to the home position HP outside of the path. The sheet bundle holding means 30 moves the sheet bundle Sa along the bookbinding path P5 from the adhesive application position X to the binding position K. At the same time, a cover sheet is conveyed to the binding position K and set at the cover sheet conveyance path P4.

As shown in FIG. 9, the cover sheet binding means is composed of a backside pressing plate 64. The backside pressing plate 64 is disposed to advance and retract between a backup position advanced into the bookbinding path P5 and a retracted position that is retracted from the path. The backside pressing plate 64 supports at the backup position the backside of the cover sheet set at the cover sheet conveyance path P4. The sheet bundle Sa conveyed from the bookbinding path P5 by the sheet bundle holding means 30 and the cover sheet are joined in an upside-down T-shape. The backside pressing plate 64 opens the bookbinding path P5 at the retracted position, and by retracting from the bookbinding path P5, the sheet bundle holding means 30 is able to convey the sheet bundle toward the folding rollers 70 positioned downstream.

Therefore, the backside pressing plate 64 is supported on the apparatus frame to move intersecting the bookbinding path P5 in a perpendicular direction. The backside pressing plate 64 is connected to drive means, not shown, such as an electromagnetic solenoid or motor or the like. Of particular note, the backside pressing plate 64 is formed by a metal plate with high coefficient of thermal conductivity and good heat dissipation effect, and can cool the adhesive applied to the sheet bundle Sa. The cover sheet and sheet bundle Sa are joined into an upside-down T-shape while being supported on their backsides by the backside pressing plate 64. The cover sheet folding means 65 that folds the backside of the cover sheet in this state is disposed at an upstream side of the backside pressing plate 64.

The disclosure of Japanese Patent Application No. 2006-128707 filed on May 2, 2006 is incorporated as a reference.

While the invention has been explained with reference to the specific embodiments of the invention, the explanation is illustrative and the invention is limited only by the appended claims.

What is claimed is:

1. An adhesive applicator comprising:

sheet bundle holding means that holds a sheet bundle at a predetermined posture;

an adhesive container that stores adhesive;

applicator roller means disposed in the adhesive container;

moving means that drives the applicator roller means or the sheet bundle holding means so that the applicator roller means and sheet bundle move relative to each other; and a scraper blade that adjusts an adhesive layer applied to a backside of the sheet bundle by the applicator roller means to a predetermined thickness, said scraper blade being disposed above the adhesive container to move relative to a backside of the sheet bundle, the scraper blade being formed of a plate-shaped member inclined at an acute angle with respect to a sheet bundle thickness direction intersecting a direction that the sheet bundle or the scraper blade moves to push away excess adhesive from one end of the sheet bundle in the thickness direction to the other end thereof across the backside, wherein the scraper blade is inclined with respect to both sheet thickness direction and sheet width direction.

2. The adhesive applicator according to claim 1, wherein the scraper blade forms a predetermined gap with a backside edge of the sheet bundle.

3. The adhesive applicator according to claim 2, wherein the scraper blade has a projection near the sheet bundle edge that pushes excess adhesive, and the projection gradually narrows the gap with the backside edge.

4. The adhesive applicator according to claim 1, wherein the acute angle is set away from the applicator roller means to drop excess adhesive into the adhesive container.

5. The adhesive applicator according to claim 1, wherein the scraper blade has an upper edge inclined with respect to both sheet width direction and sheet thickness direction.

6. An adhesive applicator comprising:

sheet bundle holding means that holds a sheet bundle at a predetermined posture;

an adhesive container that stores adhesive;

applicator roller means disposed in the adhesive container;

moving means that drives the applicator roller means or the sheet bundle holding means so that the applicator roller means and sheet bundle move relative to each other; and a scraper blade that adjusts an adhesive layer applied to a backside of the sheet bundle by the applicator roller means to a predetermined thickness, said scraper blade being disposed above the adhesive container to move relative to a backside of the sheet bundle, the scraper blade being configured to push away excess adhesive from one end of the sheet bundle to the other end thereof across the backside, wherein the scraper blade forms a predetermined gap with a backside edge of the sheet bundle, and is composed of a plate-shaped member set at a predetermined angle with regard to the backside of the sheet bundle to push away excess adhesive from the one end of the backside to the other end, and the gap gradually narrows toward an edge of the sheet bundle to push away excess adhesive.

7. An adhesive applicator comprising:

sheet bundle holding means that holds a sheet bundle at a predetermined posture;

an adhesive container that stores adhesive;

applicator roller means disposed in the adhesive container;

applicator roller moving means that moves the applicator roller means along a backside of the sheet bundle;

a scraper blade that adjusts an adhesive layer applied to the backside of the sheet bundle by the applicator roller means to a predetermined thickness; and blade moving means that moves the scraper blade along the backside of the sheet bundle, wherein said scraper blade forms a predetermined gap with the backside edge of the sheet bundle, and comprises a plate-shaped member inclined at an acute angle with regard to a sheet bundle thickness direction intersecting a direction that the sheet bundle or the scraper blade moves to push away excess adhesive from one end of the backside in the sheet bundle thickness direction to the other end thereof, wherein the scraper blade is inclined with respect to both sheet thickness direction and sheet width direction.

8. The adhesive applicator according to claim 7, wherein the adhesive container is disposed to move along the backside of the sheet bundle, and is equipped with an adhesive container moving means that reciprocates the adhesive container; wherein the applicator roller means and scraper blade are installed in the adhesive container; and the applicator roller moving means and blade moving means comprise the container moving means.

9. The adhesive applicator according to claim 8, wherein the scraper blade forms a predetermined gap with the backside of the sheet bundle, and the gap gradually narrows toward an edge of the sheet bundle to push away excess adhesive.

10. The adhesive applicator according to claim 8, wherein the scraper blade forms a predetermined gap with the backside of the sheet bundle, and has a projection near the sheet bundle edge that pushes excess adhesive, and the projection gradually narrows the gap with the backside edge.

11. The adhesive applicator according to claim 8, wherein the scraper blade comprises a flat plate-shaped member, and the predetermined gap is formed between a knife-edge of the plate-shaped member and the backside edge of the sheet bundle; and a level formed at a bottom, opposite side of the knife-edge of the plate-shaped member, gradually narrows the edge that pushes the excess adhesive.

12. The adhesive applicator according to claim 7, wherein the scraper blade forms a predetermined gap with the backside of the sheet bundle, and the gap gradually narrows toward an edge of the sheet bundle to push away excess adhesive.

13. The adhesive applicator according to claim 7, wherein the scraper blade forms a predetermined gap with the backside of the sheet bundle, and has a projection near a sheet bundle edge that pushes excess adhesive, and the projection gradually narrows the gap with the backside edge.

14. The adhesive applicator according to claim 7, wherein the plate-shaped member is inclined across the backside to push away excess adhesive from one end of the backside of the sheet bundle to the other end; and the acute angle is set away from the applicator roller means to drop excess adhesive into the adhesive container.

15. The adhesive applicator according to claim 7, wherein the scraper blade comprises a flat plate-shaped member, and the predetermined gap is formed between a knife-edge of the plate-shaped member and the backside edge of the sheet bundle; and a level formed at a bottom, opposite side of the knife-edge of the plate-shaped member, gradually narrows the edge that pushes the excess adhesive.

16. The adhesive applicator according to claim 7, wherein the scraper blade has an upper edge inclined with respect to both sheet width direction and sheet thickness direction.

17. A bookbinding apparatus, comprising:

sheet stacking means that stacks sheets into a sheet bundle;

an adhesive applicator that applies adhesive to a backside of a sheet bundle from the sheet stacking means;

cover sheet binding means that joins a cover sheet to the sheet bundle from the adhesive applicator; and cover sheet folding means that folds the cover sheet over the sheet bundle positioned at the cover sheet binding means;

wherein the adhesive applicator has the configuration of claim 1.

18. A bookbinding apparatus, comprising:

sheet stacking means that stacks sheets into a sheet bundle;

an adhesive applicator that applies adhesive to a backside of a sheet bundle from the sheet stacking means;

cover sheet joining means that joins a cover sheet to the sheet bundle from the adhesive applicator;

cover sheet folding means that folds the cover sheet over the sheet bundle positioned at the cover sheet binding means;

wherein the adhesive applicator has the configuration of claim 6.

* * * * *